US007746621B2

(12) United States Patent
Jung et al.

(10) Patent No.: US 7,746,621 B2
(45) Date of Patent: Jun. 29, 2010

(54) BAR TYPE IONIZER

(75) Inventors: Yong-Chul Jung, Pusan (KR); Byung-Soo Lee, Gimhae (KR); Min-Ho Jung, Pusan (KR); Chung-Han Shim, Pusan (KR)

(73) Assignee: Sunje Hitek Co., Ltd., Pusan (KR)

( * ) Notice: Subject to any disclaimer, the term of this patent is extended or adjusted under 35 U.S.C. 154(b) by 405 days.

(21) Appl. No.: 11/918,827

(22) PCT Filed: Feb. 9, 2006

(86) PCT No.: PCT/KR2006/000463

§ 371 (c)(1),
(2), (4) Date: Oct. 18, 2007

(87) PCT Pub. No.: WO2006/112595

PCT Pub. Date: Oct. 26, 2006

(65) Prior Publication Data

US 2009/0103229 A1 Apr. 23, 2009

(30) Foreign Application Priority Data

Apr. 19, 2005 (KR) ..... 10-2005-0032534

(51) Int. Cl.
*H05F 3/00* (2006.01)

(52) U.S. Cl. ..... 361/230

(58) Field of Classification Search ..... 361/230
See application file for complete search history.

(56) References Cited

U.S. PATENT DOCUMENTS 4,048,667 A * 9/1977 Brennecke ..... 361/213
6,126,722 A * 10/2000 Mitchell et al. ..... 95/57
6,504,702 B1 * 1/2003 Noll ..... 361/229

FOREIGN PATENT DOCUMENTS

JP 13-35686 2/2001
JP 14-216994 8/2002
KR 10-2003-0003523 1/2003

* cited by examiner

*Primary Examiner*—Stephen W Jackson
(74) *Attorney, Agent, or Firm*—Dilworth & Barrese LLP

(57) ABSTRACT

A bar type ionizer has a discharging electrode, a ground electrode, a high voltage unit, and a controller unit and uses the technique of eliminating static electricity by corona discharging. The ionizer also has a FND unit mounted on the bar which lets the user see the bar information including address of the bar, frequency, duty rate, alarm, run/stop state easily, plus buttons that let the user control the bar information easily, an air supply device installed around the needles in the air injecting socket which sends air, and a second air supply device installed around the needles having round sections and sending air to the end of the needles to eliminate the dust attached on the end of the needles. The ionizer has a streamlined section so that inside air flows smoothly. The second air supply device is elliptic with the minor axis smaller than the radius of the needle. The needle is positioned at the center of this elliptic groove and fixed by it.

18 Claims, 5 Drawing Sheets

[Fig. 1]
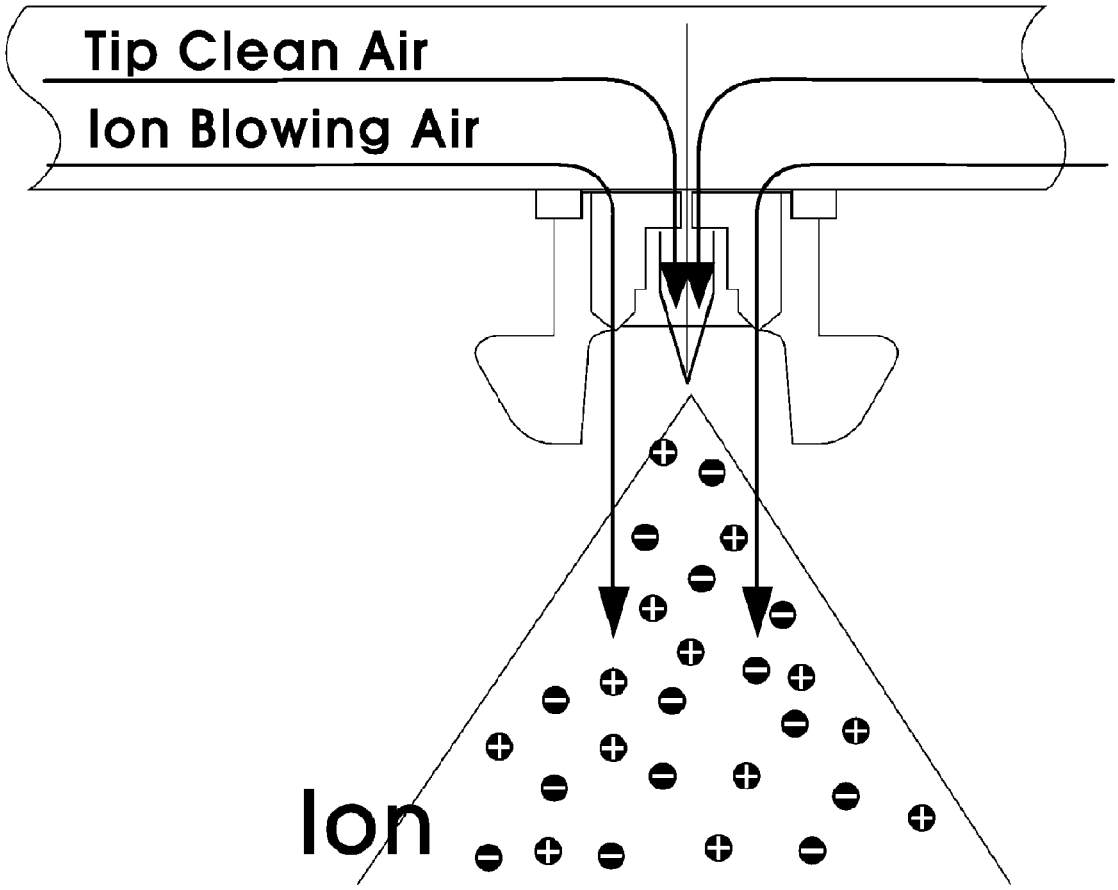
[Fig. 2]
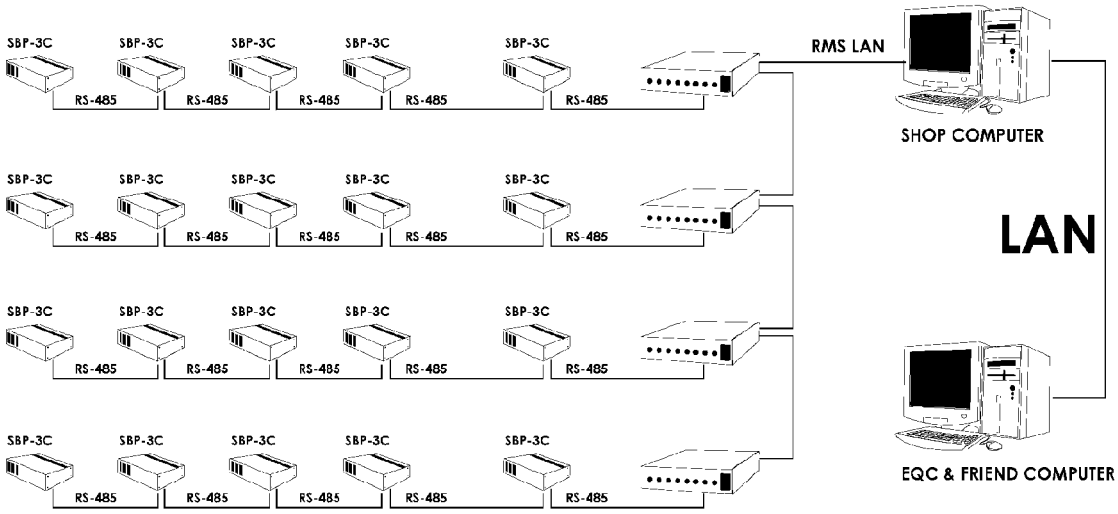

[Fig. 3]

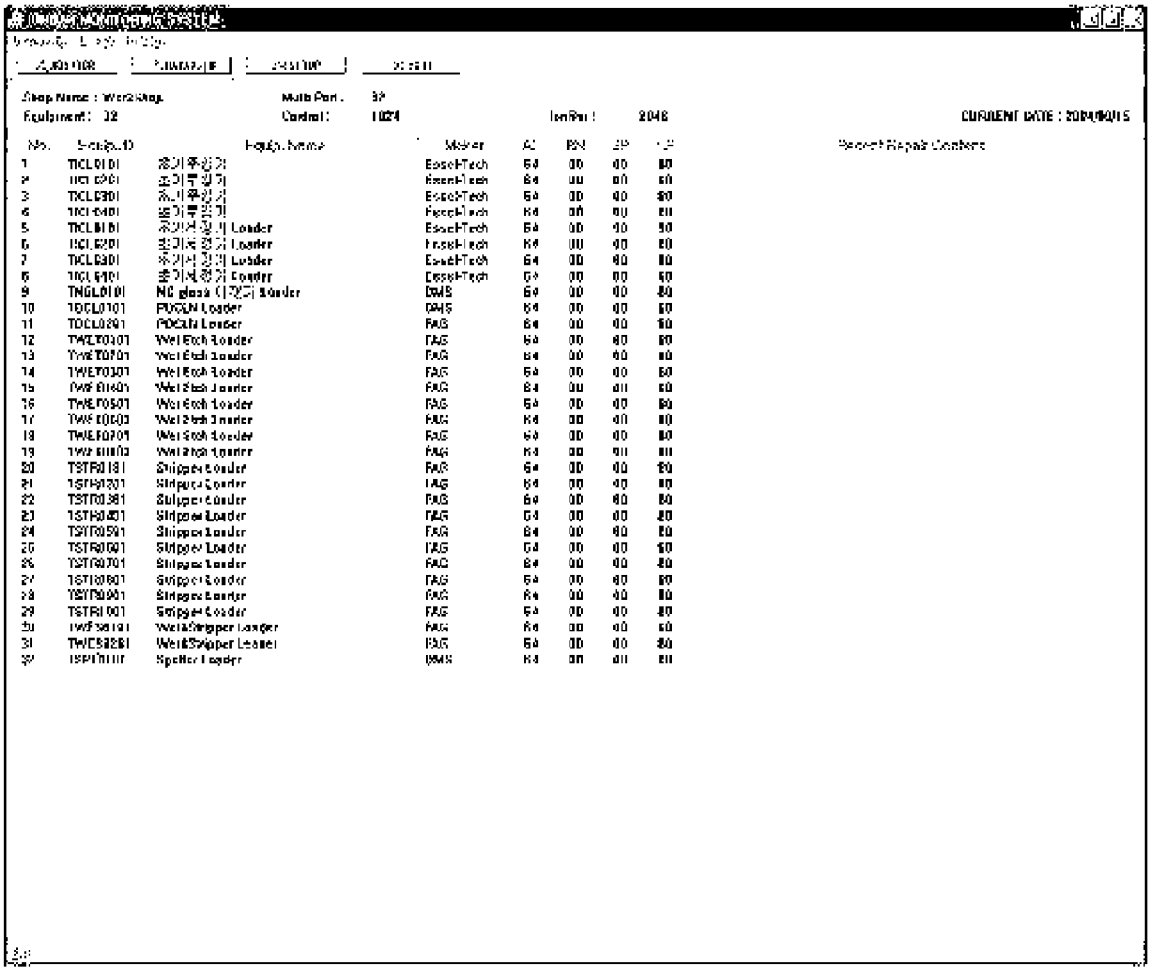

Shop Name : Wet2Ang.
Equipment : 32
Control : 1024
2048
CURRENT DATE : 2004/06/15

| No. | Equip.ID | Equip.name | Mover | A1 | B1 | 2P | 1P | Recent Repair Counters |
|---|---|---|---|---|---|---|---|---|
| 1 | TICL0101 | 초기투입기 | EssetTech | 64 | 00 | 40 | 80 | |
| 2 | TICL0201 | 초기투입기 | EssetTech | 64 | 00 | 40 | 80 | |
| 3 | TICL0301 | 초기투입기 | EssetTech | 64 | 00 | 40 | 80 | |
| 4 | TICL0401 | 초기투입기 | EssetTech | 64 | 00 | 40 | 80 | |
| 5 | TICL0101 | 초기세정기 Loader | EssetTech | 64 | 00 | 40 | 80 | |
| 6 | TICL0201 | 초기세정기 Loader | EssetTech | 64 | 00 | 40 | 80 | |
| 7 | TICL0301 | 초기세정기 Loader | EssetTech | 64 | 00 | 40 | 80 | |
| 8 | TICL0401 | 초기세정기 Loader | EssetTech | 64 | 00 | 40 | 80 | |
| 9 | TNGL0101 | NG glass 이송기 Loader | DMS | 64 | 00 | 40 | 80 | |
| 10 | TOCL0101 | POCLN Loader | DMS | 64 | 00 | 40 | 80 | |
| 11 | TOCL0201 | POCLN Loader | FAG | 64 | 00 | 40 | 80 | |
| 12 | TWET0101 | Wet Etch Loader | FAG | 64 | 00 | 40 | 80 | |
| 13 | TWET0201 | Wet Etch Loader | FAG | 64 | 00 | 40 | 80 | |
| 14 | TWET0301 | Wet Etch Loader | FAG | 64 | 00 | 40 | 80 | |
| 15 | TWET0401 | Wet Etch Loader | FAG | 64 | 00 | 40 | 80 | |
| 16 | TWET0501 | Wet Etch Loader | FAG | 64 | 00 | 40 | 80 | |
| 17 | TWET0601 | Wet Etch Loader | FAG | 64 | 00 | 40 | 80 | |
| 18 | TWET0701 | Wet Etch Loader | FAG | 64 | 00 | 40 | 80 | |
| 19 | TWET0801 | Wet Etch Loader | FAG | 64 | 00 | 40 | 80 | |
| 20 | TSTR0181 | Stripper Loader | FAG | 64 | 00 | 40 | 80 | |
| 21 | TSTR0281 | Stripper Loader | FAG | 64 | 00 | 40 | 80 | |
| 22 | TSTR0381 | Stripper Loader | FAG | 64 | 00 | 40 | 80 | |
| 23 | TSTR0481 | Stripper Loader | FAG | 64 | 00 | 40 | 80 | |
| 24 | TSTR0581 | Stripper Loader | FAG | 64 | 00 | 40 | 80 | |
| 25 | TSTR0601 | Stripper Loader | FAG | 64 | 00 | 40 | 80 | |
| 26 | TSTR0701 | Stripper Loader | FAG | 64 | 00 | 40 | 80 | |
| 27 | TSTR0801 | Stripper Loader | FAG | 64 | 00 | 40 | 80 | |
| 28 | TSTR0901 | Stripper Loader | FAG | 64 | 00 | 40 | 80 | |
| 29 | TSTR1001 | Stripper Loader | FAG | 64 | 00 | 40 | 80 | |
| 30 | TWES0181 | Wet&Stripper Loader | FAG | 64 | 00 | 40 | 80 | |
| 31 | TWES0281 | Wet&Stripper Loader | FAG | 64 | 00 | 40 | 80 | |
| 32 | TSPT0101 | Spotter Loader | DMS | 64 | 00 | 40 | 80 | |

[Fig. 4]
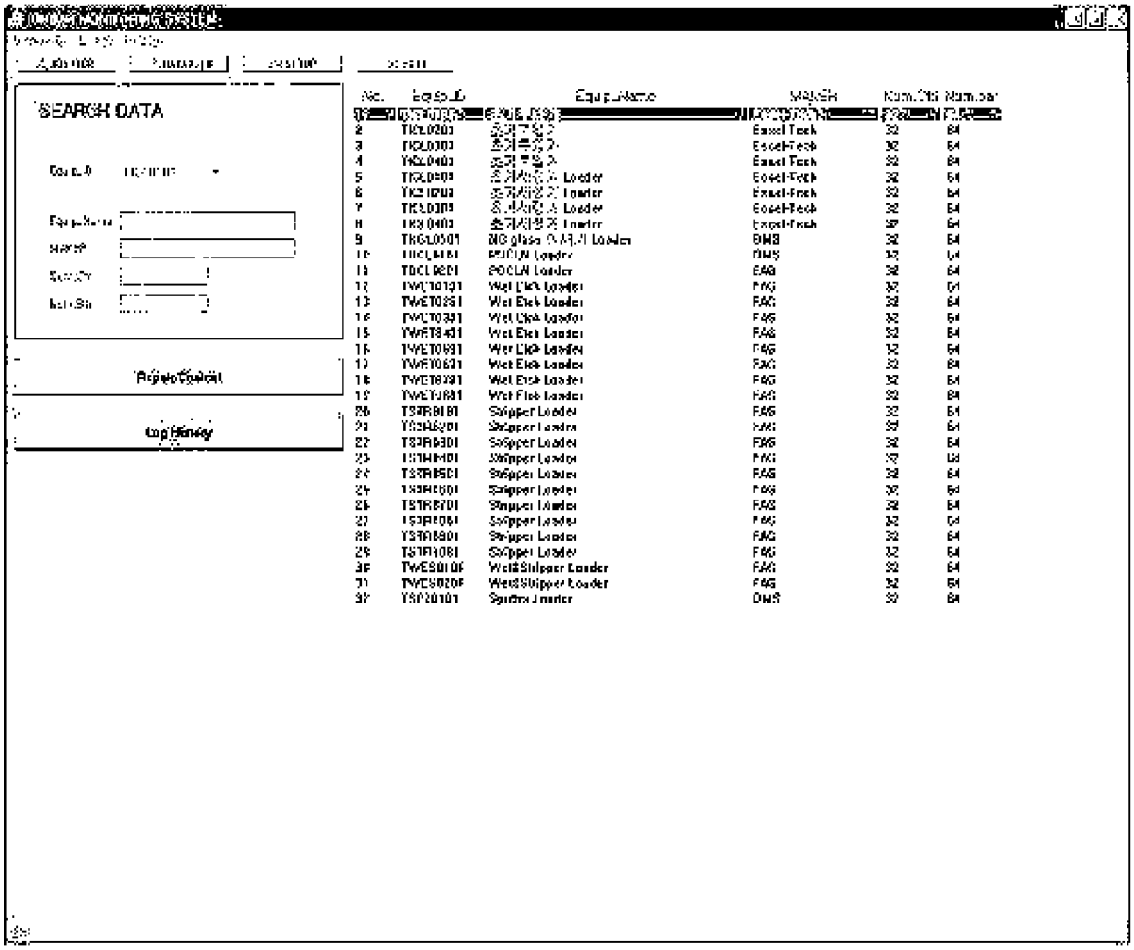

[Fig. 5]
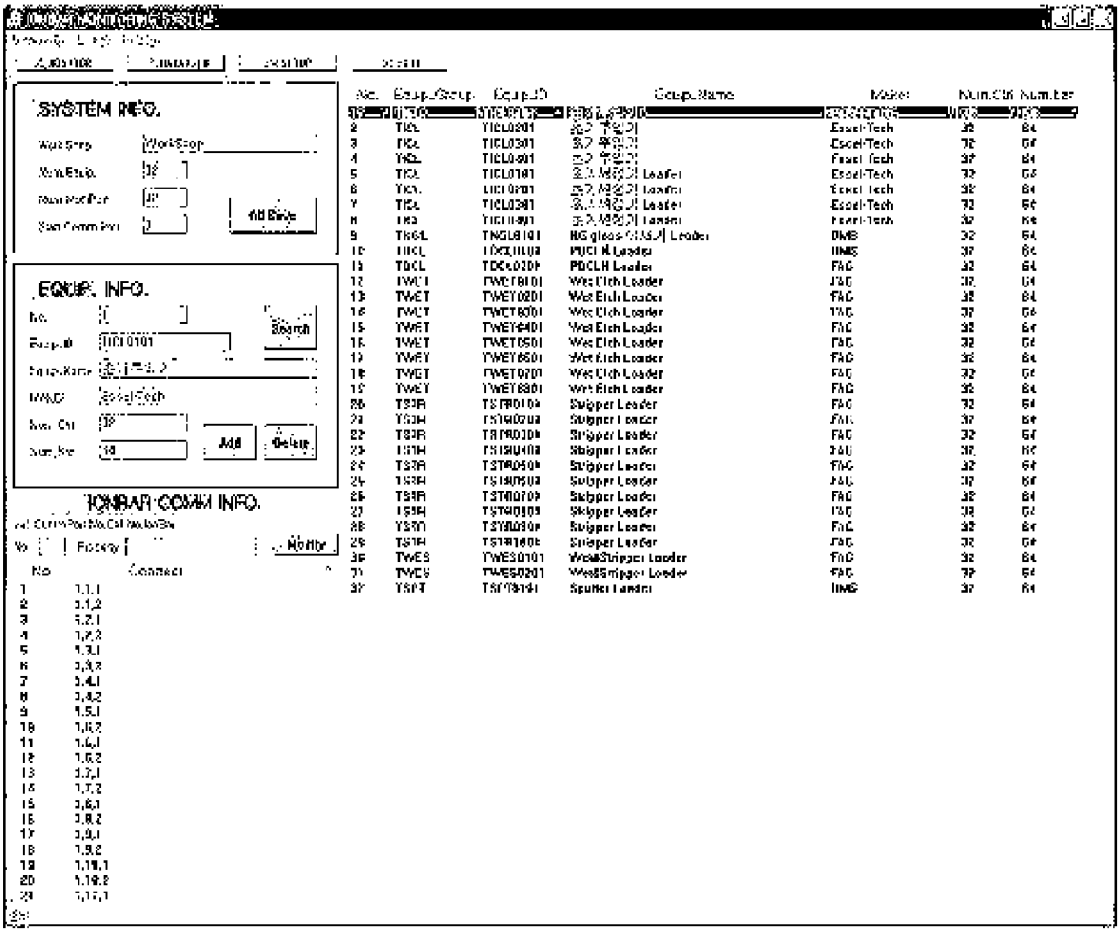
[Fig. 6]
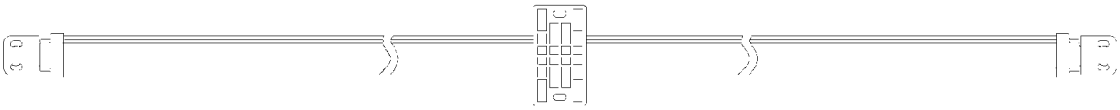
[Fig. 7]
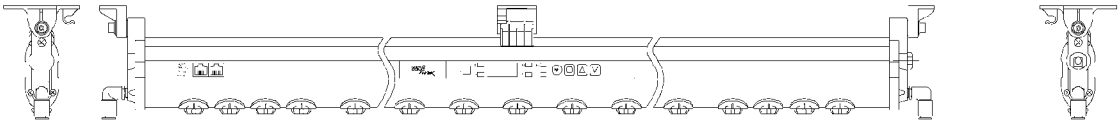
[Fig. 8]
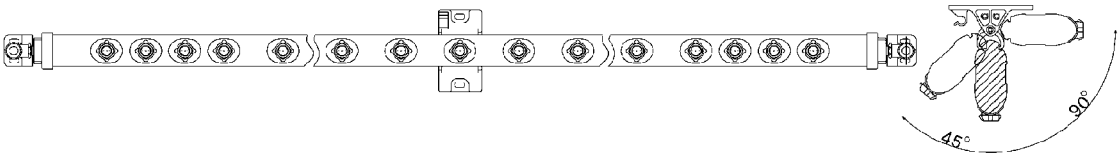
[Fig. 9]
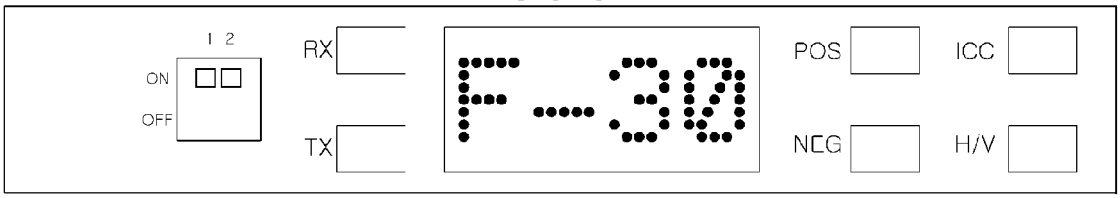

[Fig. 10]
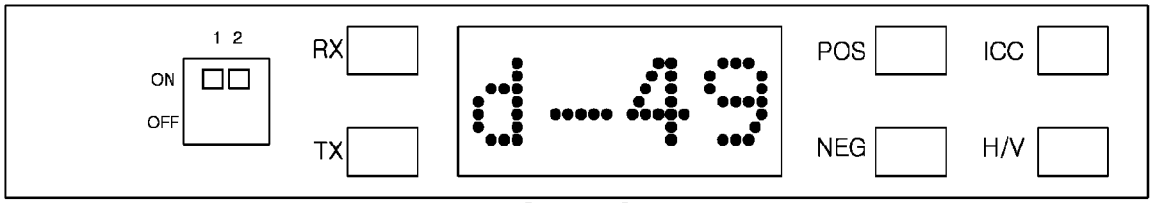
[Fig. 11]
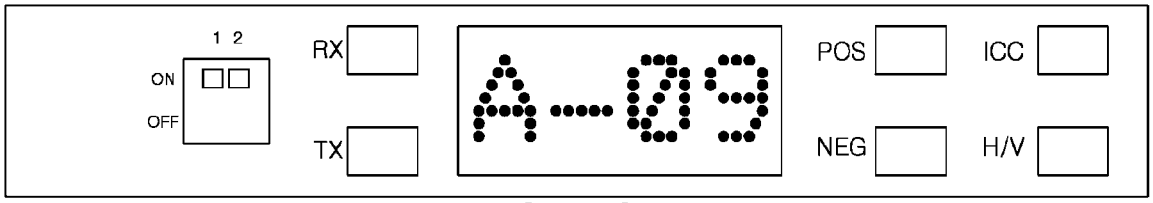
[Fig. 12]
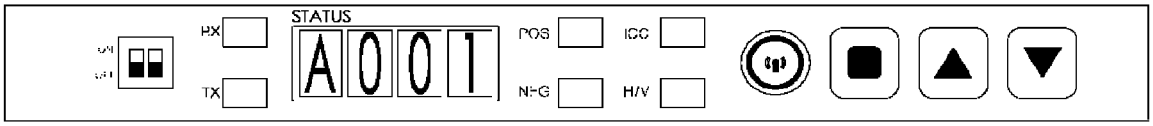

BAR TYPE IONIZER

TECHNICAL FIELD

This invention relates to a bar type ionizer, particularly a technique that can control the information like the duty rate and the frequency of the pulse AC high voltage by the bar of an ionizer generating ions by corona discharging method, and can improve the air injecting socket.

BACKGROUND ART

As a prior art of this technical area, there is an invention of "A bar type corona discharged electrostatic eliminator equipped with air vessel using pulse AC high voltage power source" filed with the Korean Intellectual Property Office on 13 Aug. 2004 by the patent application number 10-2004-64064. As other prior arts, there are Korean patent gazette publication number 10-2003-3523 (Apparatus for removing an static electricity by high frequency voltage), Japanese patent gazette publication number P2001-35686 (DC static eliminator), Japanese patent gazette publication number P2002-216994 (Pulse AC type static eliminator), etc.

The previous bar type ionizers had various defects. First, it was very inconvenient to see various information indicated at the bar (for example, bar address, frequency, duty rate, alarm, run/stop state) since the information was shown by LED instead of characters. And controlling this information was possible only by special monitoring equipment instead of a bar itself. Furthermore, ions were not generated sufficiently because of particles like dust stuck on the end of the needle inside of the tip.

DISCLOSURE OF INVENTION

Technical Problem

The purpose of this invention is to provide a bar type ionizer that can solve the above defects of the prior arts.

Other purposes and merits of this invention will be clear upon reading the detailed explanation and referring to the attached drawings.

Technical Solution

An embodiment of a bar type ionizer according to this invention having a discharging electrode, a ground electrode, a high voltage unit, and a controller unit and using the technique of eliminating static electricity by corona discharging method comprises, a FND unit mounted on the bar and lets the user see the bar information including address of the bar, frequency, duty rate, alarm, run/stop state easily; buttons that lets the user control said bar information easily; a first air supplying means installed around the needles in the air injecting socket and sends air; and a second air supplying means installed around the needles having round sections and sends air to the end of the needles in order to eliminate the dust stuck on the end of the needles, and has a streamlined section so that inside air flows smoothly.

In the preferred embodiment of this invention, the first air supplying means is a cylindrical groove for the air pass, the second air supplying means is elliptic and the minor axis of it is smaller than the radius of the needle, and the needle is positioned at the center of this elliptic groove and fixed by it.

In this embodiment, said FND unit comprises a FND window to display the bar information as characters, a POS LED to check if '+' voltage is outputted from the bar normally, an NEG LED to check if '−' voltage is outputted from the bar normally, a H/V LED to check the internal H/V output, an ICC LED to control ion current, a DIP switch used when setting the ionizer, an LED to show the status of transmitting and receiving, a remote control signal receiving unit, an up/down button to control the set up value, and a CONFIRM button to confirm the set up value.

In this embodiment, ion generation type adopts a corona discharging method, input power is AC 110~240 volt with 50~60 hertz, frequency is 1~60 hertz, duty rate is 30~70%, residual voltage stays within ±50 volt, alarm rings if high voltage gets low or the amount of ion generation gets little, and ozone concentration is 0.004~0.005 ppm, air pressure and air consumption have CDA, $N_2$(maximum 5 kgf/mm), 8Φ, 3 kgf/mm−210 min/l 5 kgf/mm−350 min/l. The main body material is Non-Flammable ABS, and the cover material is SUS-304, the electrode material is tungsten with 99.99 degree of purity, and as operating circumstance temperature of 0~50° C. and humidity of 35~85% RH are necessary.

And slot holes are shaped at both ends of the bar, a number of holes (tips) from which the ions come out are shaped below the bar, the direction of the hole from which said ions come out can be controlled according to the position of the charged body, the space between the tips is 36.5 mm or 55 mm, and the tips are shaped from the point that is 60 mm apart from the end of the bar, the width of the bar is 34.4 mm, the length of the bar is 1,677 mm~3,107mm.

Meanwhile another embodiment of this invention relates to an RMS (Read Monitoring System) that reads and monitors data of said bar type ionizer comprising, a controller that connects a number of bar type ionizers; a number of HUBs that connect a number of controllers per one channel in serial; a first PC prepared in the field to monitor the total ionizers of the system by connecting said numbers of HUBs in serial; and a second PC prepared at the outside of the field that is connected with said first PC by LAN, scenes displayed by said RMS display mode includes monitoring view, data view, and setup view, and each scene of said display mode has "Display (D)", "Exit (X)", and "Help (H)" on the menu bar, and has buttons of "MONITOR", "DATAVIEW", "SETUP", and "EXIT", and said ion bar is an air flow type ion bar.

ADVANTAGEOUS EFFECTS

Particle is seldom generated from the bar itself by executing this invention. And it is convenient to recognize the information indicated at the bar since it is expressed as characters by FND. In addition, remotely controlling a number of bars is possible, and collective management is possible by structuring the network. Moreover controlling the bar information is possible at the bar itself.

BRIEF DESCRIPTION OF THE DRAWINGS

FIG. 1 illustrates a radiation of ions from the tip of a bar type ionizer according to this invention.

FIG. 2 illustrates an example of a structure of the system that reads and monitors data of a bar type ionizer according to this invention.

FIG. 3 illustrates an example of a display mode of an RMS system according to this invention (in case of monitoring view).

FIG. 4 illustrates an example of a display mode of an RMS system according to this invention (in case of data view).

FIG. 5 illustrates an example of a display mode of an RMS system according to this invention (in case of setup view).

FIG. 6 illustrates a top view of an embodiment of a bar type ionizer according to this invention.

FIG. 7 illustrates a left side view of an embodiment of a bar type ionizer according to this invention.

FIG. 8 illustrates a bottom view of an embodiment of a bar type ionizer according to this invention.

FIG. 9 illustrates an example of a frequency setting mode at the FND unit of a bar type ionizer according to this invention.

FIG. 10 illustrates an example of a duty rate setting mode at the FND unit of a bar type ionizer according to this invention.

FIG. 11 illustrates an example of an address setting mode at the FND unit of a bar type ionizer according to this invention.

FIG. 12 illustrates an embodiment of the FND unit of a bar type ionizer according to this invention.

BEST MODE FOR CARRYING OUT THE INVENTION

Now referencing the attached drawings, we make a more detailed explanation about the structure and the principle of the operation of the invention.

1. Improvement of the Function of Information Display by Adopting FND

The previous bar type ionizer had an LED on the bar and it was very inconvenient for the user to see the information like bar address, frequency, duty rate, alarm, run/stop state through the LED, but in this invention the user can see the information easily through FND mounted on the bar. And the bar type ionizer of this invention has special buttons of POS, ICC, NEG, H/V on the bar that let the user control the information easily. POS is to check if +voltage is outputted from the bar normally, NEG is used to check if '−' voltage is outputted from the bar normally, and H/V is used to check the internal H/V output. If an abnormal condition arises on the high voltage output, the ionizer stops running. ICC (Ion Current Control) is used to control the ion current.

Broadly speaking, FND window has the following big 5 function. Firstly, there are function for displaying address of the ion bar, setting the operation frequency of the ion bar, setting duty rate for said frequency, displaying run/stop state by external signal input (in case of remote input), and alarming.

FIG. 9 illustrates an example of FND (in case of frequency setting mode), FIG. 10 illustrates an example of FND (in case of duty rate setting mode), and FIG. 11 illustrates an example of FND (in case of address setting mode) according to this invention.

2. Improvement of an Air Socket

An air socket as shown in FIG. 1 is used in this invention. Prior art had a problem in generating ions because of dust attached on the air socket especially on the needle. In this invention as shown in FIG. 1, air comes out from everywhere around the inner needles of the air socket and ions come out from the central needle. And the dust stuck on the end of the needle is eliminated by the air that comes out from the groove shaped around the needle and flows toward the end of the needle. By this method ions are emitted from the needle normally.

3. Improvement of the Section of the Bar

In general, air flows from the ceiling of an air clean room and the ceiling functions as an air filter, so the air flow of the bar type ionizer installed on the ceiling is affected. In this invention, the air flows smoothly by shaping the section of the bar as a streamline It can improve the emission of the ions indirectly.

4. Other Improvements

In this invention, ion generation type adopts a corona discharging method, input power is AC 110~240 volt of 50~60 hertz, frequency is 1~60 hertz, duty rate is 30~70%, residual voltage is within ±50 volt, alarm rings if high voltage gets low or the amount of ion generation gets little.

And ozone concentration is 0.004~0.005 ppm, air pressure and air consumption have CDA, $N_2$(maximum 5 kgf/□), 8Φ, 3 kgf/□−210 min/l, 5 kgf/□−350 min/l. The main body material is Non-Flammable ABS, the cover material is SUS-304, the electrode material is tungsten with 99.99 degree of purity, operating circumstance needs temperature of 0~50° C., humidity of 35~85% RH.

This invention is suitable for the clean room whose class is 1000 under. That is, it is suitable for the clean room in which the number of particles of dust should be fewer than 1000 per 1□. This invention is designed as a needle socket type and particle is not generated in ionization. And the particle attached on the needle is always cleaned up by air injection surrounding the electrode.

Besides, it is designed to display high clear vision for the operator, and X-material of the electrode decreases remarkably anti-particle deposition on the electrode-tip.

MODE FOR THE INVENTION

5. Improvement of an RMS

Now we explain about an RMS (Read Monitoring System) that reads and monitors ionizer data of this invention. Ion bar type ionizer is installed at a large scale production line in general. An example is connecting two ion bars with one controller as shown in FIG. 2. As there are 5 controllers at the first line of FIG. 2, they controls 10 ion bars. These controllers are connected each other in serial by RS-485 and a HUB is installed at the end of the connection. In this embodiment, each HUB takes charge 5 controllers, and these 4 HUBs are connected each other in serial by exclusive lines (RMS LAN), and a first HUB is connected to a Shop PC (prepared in the clean room) that manages the field, and the information of said PC is connected to a PC prepared at the outside of the clean room by an inner communication line like the LAN. In this case, one controller can control 16 ion bars to the maximum, one HUB uses 8~32 channels usually, one channel takes charge 32 controllers. So one HUB can take charge 32×2×16=16=16,384 ionizers if it uses 32 channels. Therefore, 65,356 ionizers can be controlled by 4 HUBs. We can monitor this number of ionizers conveniently with one PC prepared in the field.

An example of display mode of an RMS according to this invention is shown in FIG. 3 to FIG. 5. FIG. 3 shows an example of a scene of a Monitoring View. That is, Serial number, equipment ID, equipment name, maker, AL, RN, SP, CF are displayed in the scene. At this time Shop name, multi port number, the number of equipment, control number, ion bar number, current date are also displayed. Tools of 'Display', 'Exit', 'Help' are prepared at the tool bar located at the top of the scene, and several function buttons are prepared below that too. For example, it is preferable to prepare 'Monitor', 'Dataview', 'Setup', 'Exit' for the function buttons.

FIG. 4 is an example of a scene of Data view. Tools of 'Display', 'Exit', 'Help' are prepared at the tool bar, and function buttons like 'Monitor', 'Dataview', 'Setup', 'Exit' are prepared below that. The scene in FIG. 4 shows searched data. Equipment ID, Equipment name, Maker, Number of control, Number of bar are shown as a basic information and searched data is displayed as the scene in FIG. 4.

FIG. 5 is an example of a scene of Setup view. Tools of 'Display', 'Exit', 'Help' are prepared at the tool bar, and function buttons 'Monitor', 'Dataview', 'Setup', 'Exit' are prepared below that. The scene in FIG. 5 shows system information, equipment information, ion bar communication information. In system information, if the operator inputs work shop, equipment name, number of multi port, start communication port and push 'ALL Save' button, all of them are saved. In equipment information, if the operator inputs serial number, equipment ID, equipment name, maker, number of control, number of bar and pushes the buttons of 'Search', 'Add', 'Delete', then the desired functions are executed. In ion bar communication information, if the operator inputs number of communication port and properties and pushes a 'Modify' button, the information of connection states is displayed. The setup information is displayed at the right side of the scene. This information contains serial number, equipment group, equipment ID, equipment name, maker, number of control, and number of bar.

This invention requires a computer having a CPU over Pentium 4, a memory over 256M, a graphic card supporting resolution of 1,280×1,024, operating system of Window XP. It also requires a card supporting 32 channels, an equipment connecting 32 ports, communication type of RS-485, and Baud rate of 2400 bps~9,600 bps.

The ion bar ionizer of this invention is an air flow type ionizer. FIG. 6, FIG. 7, and FIG. 8 shows an embodiment an ion bar of this invention. Slot holes are shaped at both ends of the bar as shown in FIG. 6. This hole is also called as tip. A number of holes from which the ions come out (30 to 56 for example) are shaped below the bar as shown in FIG. 7. The direction of the hole from which the ions come out can be controlled according to the position of the charged body. Generally they are installed to rotate 45° or 90°. The space between the tips is 36.5□ or 55□, and it is preferable to shape the tips from the point that is 60□ apart from the end of the bar. The width of the bar is 34.4□. The length of the bar can be varied from 1,677□ to 3,107□.

The section of the bar ionizer is a streamline. This is to make the inside air flow smoothly.

The technical structure of a bar type ionizer of this invention and prior art is arranged in table 1. FIG. 12 shows an embodiment of an FND unit of the bar type ionizer according to this invention.

TABLE 1

| | Items | This invention | Prior art |
|---|---|---|---|
| Emitter module | Input power | 12/24 VDC (modular lack) | 24 VDC (modular lack) |
| | Output power | Pulsed AC 13 KVpp | Pulsed AC 14 KVpp |
| | Output current | 150~250 mA | 150~250 mA |
| | Output control and regulation | Duty rate control by remote controller. Control buttons are mounted on the bar. Power controller is not necessary. | Duty rate control by remote controller. |
| | Discharge mode | Pulsed AC | Pulsed AC |
| | Emitter material | Tungsten/Silicon on Tungsten | Tungsten/Silicon on Tungsten |
| | Installed Distance | 50~2,000 mm | 50~2,000 mm |
| | Length | 800~3,000 mm | 360~1,560 mm |
| | Cover material | ABS | ABS |
| | Emitter replacement | Cartridge | Cartridge |
| | Air supply | CDA or $N_2$ | CDA or $N_2$ |
| Power controller | Input Voltage | 100~240 VAC, 50/60 Hz | 100 VAC, 50/60 Hz |
| | Output Voltage | 12 V/24 VCD | 24 VCD |
| | Pulse frequency | 0.03 sec~10 sec(0.1 Hz~30 Hz) | 0.03 sec~10 sec(0.1 Hz~30 Hz) |
| | Pulse duty rate | 30~70% | 40~60% |
| | Control method. | Remote controller/Local | Remote controller/Local |
| | Display and Communication with outer computers | LCD/RS-485 | LCD/RS-485 |
| | Function | 1. Ion current alarm<br>2. High voltage abnormal alarm<br>3. Communication alarm | 1. Condition alarm<br>2. Ion level alarm |
| | Important Features | 1. Cheap emitter | |

6. Method of Setting an Ion Bar

The method of setting an ion bar is as follows. Firstly, operate the ion bar normally. Secondly, operate setting mode by pushing setting button when you want to change address, frequency and duty rate. Thirdly, set address. For example, set the address by pushing UP button or DOWN button if "A-xx" is displayed on FND window. After setting, the address is fixed by pushing a CONFIRM button. Fourthly, set frequency. Set the frequency by using a UP button and a DOWN button if "F-xx" is displayed on an FND window. This setting is also finished by pushing a CONFIRM button. Lastly, set duty rate. Set the duty rate by using a UP button and a DOWN button if "d-xx" is displayed on an FND window. This setting is finished by pushing a CONFIRM button. Push a FINISH button if the setting is finished completely. Then the ion bar starts operation.

This invention may be modified and embodied in various forms, and it has been described and illustrated herein with reference to a specific embodiment thereof. However, it should be understood that this invention is not limited to the particular form as described above, and that this invention includes all modifications, equivalents and substitutes within the spirits and scope of this invention as defined in the "claims" attached hereto.

INDUSTRIAL APPLICABILITY

It can bring about a remarkable effect if it is applied in Exposure, HPCP, Rubbing and PI costing process. Besides, it is suitable for the process of FPD (Flat Panel Display) as TFT-LCD, STN-LCD, OLED, LTPS, HTPS, PDP, semiconductor process that circular spot ionizing is indispensable, coating the surface of a plastic, printing process and nanotechnology industry.

The invention claimed is:

1. In a bar type ionizer having a discharging electrode, a ground electrode, a high voltage unit, and a controller unit and using the technique of eliminating static electricity by corona discharging, said bar type ionizer comprising:

a FND unit mounted on the bar and letting a user see the bar information including address of the bar, frequency, duty rate, alarm, run/stop state easily;

buttons letting the user control said bar information easily;

first air supplying means installed around the needles in an air injecting socket for sending air; and second air supplying means installed around the needles having round sections for sending air to the end of the needles to eliminate dust attached on the end of the needles, wherein said ionizer has a streamlined section so that inside air flows smoothly.

2. A bar type ionizer as set forth in claim 1, wherein said first air supplying means is a cylindrical groove for the air pass.

3. A bar type ionizer as set forth in claim 1, wherein said second air supplying means is elliptic with a minor axis of the elliptic smaller than radius of the needle, and the needle is positioned at the center of this elliptic groove and fixed by the groove.

4. A bar type ionizer as set forth in claim 1, wherein the ion generation type adopts corona discharging and in put power is AC 110~240 volt of 50~60 hertz and frequency is one of 1, 3, 5, 8, 10, 20, 30 hertz and duty rate is 40~60% and residual voltage stays within ±50 volt range and alarm rings if high voltage gets low or the amount of ion generation gets little and ozone concentration range is 0.004~0.005 ppm and air pressure and air consumption are CDA, $N_2$(maximum 5 kgf/), 8ϕ, 3kgf/-210 min/l, 5kgf/-350 min/l and the main body material is Non-Flammable ABS and the cover material is SUS-304 and the electrode material is tungsten with 99.99 degree of purity and operating circumstance needs temperature of 0~50 and humidity of 35~85% RH.

5. A bar type ionizer as set forth in claim 1, wherein slot holes are shaped at both ends of the bar and plurality of holes (tips) from which the ions come out are shaped below the bar and the direction of the hole from which said ions come out can be controlled according to the position of the charged body and said tips are apart at predetermined intervals, and the tips are shaped at predetermined intervals from the end of the bar.

6. A bar type ionizer as set forth in claim 1, wherein said FND unit comprises a FND window to display the bar information as characters;

a POS LED to check if '+' voltage is outputted from the bar normally;

a NEG LED to check if '−' voltage is outputted from the bar normally;

a H/V LED to check the internal H/V output;

a ICC LED to control ion current;

a DIP switch used for setting the ionizer;

a LED to show the status of transmitting and receiving;

a remote control signal receiving unit;

an up/down button to control the set up value; and a CONFIRM button to confirm the set up value.

7. In a RMS (Read Monitoring System) that reads and monitors data of a bar type ionizer according to claim 1, said RMS comprising:

a controller connecting plurality of bar type ionizers;

plurality of HUBs connecting a number of controllers per one channel in serial;

a first PC prepared in the field to monitor the total ionizers of the system by connecting said plurality of HUBs in serial; and a second PC prepared at the outside of the field connected with said first PC by LAN, wherein the scene of said RMS display mode includes monitoring view, data view, and setup view, and each scene of said display mode has "Display(D)", "Exit(X)", and "Help (H)" on the menu bar, and has buttons of "MONITOR", "DATAVIEW", "SETUP", and "EXIT", and said ion bar is an air flow type ion bar.

8. In a method of setting the ion bar of bar type ionizer according to claim 1, said method comprising steps of:

operating the ion bar normally;

operating setting mode by pushing setting button when a user wants to change address, frequency or duty rate;

setting address by pushing a UP button or a DOWN button if setting mode of the address is displayed on an FND window when the user wants to set the address value;

designating the set address value by pushing a CONFIRM button after the address setting;

setting frequency by pushing a UP button or a DOWN button if setting mode of the frequency is displayed on an FND window when the user wants to set the frequency value;

fixing the set frequency value by pushing a CONFIRM button after the frequency setting;

setting duty rate by pushing an UP button or a DOWN button if setting mode of the duty rate is displayed on an FND window when the user wants to set the duty rate;

fixing the set duty rate by pushing a CONFIRM button after the duty rate setting;

pushing a FINISH button if the desired setting of the bar information is finished; and operating the ion bar again.

9. In a RMS (Read Monitoring System) that reads and monitors data of a bar type ionizer according to claim 2, said RMS comprising:

a controller connecting plurality of bar type ionizers;

plurality of HUBs connecting a number of controllers per one channel in serial;

a first PC prepared in the field to monitor the total ionizers of the system by connecting said plurality of HUBs in serial; and a second PC prepared at the outside of the field connected with said first PC by LAN, wherein the scene of said RMS display mode includes monitoring view, data view, and setup view, and each scene of said display mode has "Display(D)", "Exit(X)", and "Help (H)" on the menu bar, and has buttons of "MONITOR", "DATAVIEW", "SETUP", and "EXIT", and said ion bar is an air flow type ion bar.

10. In a RMS (Read Monitoring System) that reads and monitors data of a bar type ionizer according to claim 3, said RMS comprising:

a controller connecting plurality of bar type ionizers;

plurality of HUBs connecting a number of controllers per one channel in serial;

a first PC prepared in the field to monitor the total ionizers of the system by connecting said plurality of HUBs in serial; and a second PC prepared at the outside of the field connected with said first PC by LAN, wherein the scene of said RMS display mode includes monitoring view, data view, and setup view, and each scene of said display mode has "Display(D)", "Exit(X)", and "Help (H)" on the menu bar, and has buttons of "MONITOR", "DATAVIEW", "SETUP", and "EXIT", and said ion bar is an air flow type ion bar.

11. In a RMS (Read Monitoring System) that reads and monitors data of a bar type ionizer according to claim 4, said RMS comprising:

a controller connecting plurality of bar type ionizers;

plurality of HUBs connecting a number of controllers per one channel in serial;

a first PC prepared in the field to monitor the total ionizers of the system by connecting said plurality of HUBs in serial; and a second PC prepared at the outside of the field connected with said first PC by LAN, wherein the scene of said RMS display mode includes monitoring view, data view, and setup view, and each scene of said display mode has "Display(D)", "Exit(X)", and "Help (H)" on the menu bar, and has buttons of "MONITOR", "DATAVIEW", "SETUP", and "EXIT", and said ion bar is an air flow type ion bar.

12. In a RMS (Read Monitoring System) that reads and monitors data of a bar type ionizer according to claim 5, said RMS comprising:

a controller connecting plurality of bar type ionizers;

plurality of HUBs connecting a number of controllers per one channel in serial;

a first PC prepared in the field to monitor the total ionizers of the system by connecting said plurality of HUBs in serial; and a second PC prepared at the outside of the field connected with said first PC by LAN, wherein the scene of said RMS display mode includes monitoring view, data view, and setup view, and each scene of said display mode has "Display(D)", "Exit(X)", and "Help (H)" on the menu bar, and has buttons of "MONITOR", "DATAVIEW", "SETUP", and "EXIT", and said ion bar is an air flow type ion bar.

13. In a RMS (Read Monitoring System) that reads and monitors data of a bar type ionizer according to claim 6, said RMS comprising:

a controller connecting plurality of bar type ionizers;

plurality of HUBs connecting a number of controllers per one channel in serial;

a first PC prepared in the field to monitor the total ionizers of the system by connecting said plurality of HUBs in serial; and a second PC prepared at the outside of the field connected with said first PC by LAN, wherein the scene of said RMS display mode includes monitoring view, data view, and setup view, and each scene of said display mode has "Display(D)", "Exit(X)", and "Help (H)" on the menu bar, and has buttons of "MONITOR", "DATAVIEW", "SETUP", and "EXIT", and said ion bar is an air flow type ion bar.

14. In a method of setting the ion bar of bar type ionizer according to claim 2, said method comprising steps of:

operating the ion bar normally;

operating setting mode by pushing setting button when a user wants to change address, frequency or duty rate;

setting address by pushing a UP button or a DOWN button if setting mode of the address is displayed on an END window when the user wants to set the address value;

designating the set address value by pushing a CONFIRM button after the address setting;

setting frequency by pushing a UP button or a DOWN button if setting mode of the frequency is displayed on an FND window when the user wants to set the frequency value;

fixing the set frequency value by pushing a CONFIRM button after the frequency setting;

setting duty rate by pushing an UP button or a DOWN button if setting mode of the duty rate is displayed on an FND window when the user wants to set the duty rate;

fixing the set duty rate by pushing a CONFIRM button after the duty rate setting;

pushing a FINISH button if the desired setting of the bar information is finished; and operating the ion bar again.

15. In a method of setting the ion bar of bar type ionizer according to claim 3, said method comprising steps of:

operating the ion bar normally;

operating setting mode by pushing setting button when a user wants to change address, frequency or duty rate;

setting address by pushing a UP button or a DOWN button if setting mode of the address is displayed on an FND window when the user wants to set the address value;

designating the set address value by pushing a CONFIRM button after the address setting;

setting frequency by pushing a UP button or a DOWN button if setting mode of the frequency is displayed on an FND window when the user wants to set the frequency value;

fixing the set frequency value by pushing a CONFIRM button after the frequency setting;

setting duty rate by pushing an UP button or a DOWN button if setting mode of the duty rate is displayed on an FND window when the user wants to set the duty rate;

fixing the set duty rate by pushing a CONFIRM button after the duty rate setting;

pushing a FINISH button if the desired setting of the bar information is finished; and operating the ion bar again.

16. In a method of setting the ion bar of bar type ionizer according to claim 4, said method comprising steps of:

operating the ion bar normally;

operating setting mode by pushing setting button when a user wants to change address, frequency or duty rate;

setting address by pushing a UP button or a DOWN button if setting mode of the address is displayed on an END window when the user wants to set the address value;

designating the set address value by pushing a CONFIRM button after the address setting;

setting frequency by pushing a UP button or a DOWN button if setting mode of the frequency is displayed on an FND window when the user wants to set the frequency value;

fixing the set frequency value by pushing a CONFIRM button after the frequency setting;

setting duty rate by pushing an UP button or a DOWN button if setting mode of the duty rate is displayed on an FND window when the user wants to set the duty rate;

fixing the set duty rate by pushing a CONFIRM button after the duty rate setting;

pushing a FINISH button if the desired setting of the bar information is finished; and operating the ion bar again.

17. In a method of setting the ion bar of bar type ionizer according to claim 5, said method comprising steps of:

operating the ion bar normally;

operating setting mode by pushing setting button when a user wants to change address, frequency or duty rate;

setting address by pushing a UP button or a DOWN button if setting mode of the address is displayed on an FND window when the user wants to set the address value;

designating the set address value by pushing a CONFIRM button after the address setting;

setting frequency by pushing a UP button or a DOWN button if setting mode of the frequency is displayed on an FND window when the user wants to set the frequency value;

fixing the set frequency value by pushing a CONFIRM button after the frequency setting;

setting duty rate by pushing an UP button or a DOWN button if setting mode of the duty rate is displayed on an FND window when the user wants to set the duty rate;

fixing the set duty rate by pushing a CONFIRM button after the duty rate setting;

pushing a FINISH button if the desired setting of the bar information is finished; and operating the ion bar again.

18. In a method of setting the ion bar of bar type ionizer according to claim 6, said method comprising steps of:

operating the ion bar normally;

operating setting mode by pushing setting button when a user wants to change address, frequency or duty rate;

setting address by pushing a UP button or a DOWN button if setting mode of the address is displayed on an FND window when the user wants to set the address value;

designating the set address value by pushing a CONFIRM button after the address setting;

setting frequency by pushing a UP button or a DOWN button if setting mode of the frequency is displayed on an FND window when the user wants to set the frequency value;

fixing the set frequency value by pushing a CONFIRM button after the frequency setting;

setting duty rate by pushing an UP button or a DOWN button if setting mode of the duty rate is displayed on an FND window when the user wants to set the duty rate;

fixing the set duty rate by pushing a CONFIRM button after the duty rate setting;

pushing a FINISH button if the desired setting of the bar information is finished; and operating the ion bar again.

* * * * *